United States Patent [19]

Sattmann

[11] 4,143,811

[45] Mar. 13, 1979

[54] GAS FLOW CONTROLLED FURNACE FLUE DAMPER

[76] Inventor:, Karl Sattmann, 941 Viewland, Rochester, Mich. 48063

[21] Appl. No.: 803,483

[22] Filed: Jun. 6, 1977

[51] Int. Cl.[2] ..... F23N 1/06; F23N 5/18

[52] U.S. Cl. ..... 236/1 G; 110/163; 126/285 B; 200/81.9 HG

[58] Field of Search ..... 236/1 G; 431/20; 110/163; 126/285 B; 116/117 R; 200/81.9 R, 81.9 HG

[56] References Cited

U.S. PATENT DOCUMENTS

| | | | |
|---|---|---|---|
| 1,737,835 | 12/1929 | Ehlers | 200/81.9 G |
| 1,813,395 | 7/1931 | Fraser | 236/1 G |
| 1,959,970 | 5/1934 | Stinson | 236/1 G |
| 2,173,370 | 4/1939 | Parachek | 200/81.9 HG |
| 2,214,092 | 9/1940 | Uhlhorn | 200/81.9 HG |
| 2,241,661 | 5/1941 | Furlong | 236/1 G |
| 2,244,373 | 6/1941 | Powers | 200/81.9 R |
| 2,808,209 | 10/1957 | Bressler | 236/1 G |
| 3,273,625 | 9/1966 | Holtzman et al. | 236/1 G |
| 3,415,119 | 12/1968 | Moore | 116/117 R |
| 4,039,123 | 8/1977 | Frankel | 236/1 G |
| 4,108,369 | 8/1978 | Prikkel | 236/1G |

*Primary Examiner*—Robert E. Garrett
*Attorney, Agent, or Firm*—Krass & Young

[57] ABSTRACT

A gas furnace employs an exhaust flue damper driven by an electric motor equipped with position indicating switches. A gas flow detector switch supported in the gas line has a vertical passage and a valve member gravity biased into a rest position in which it blocks gas flow through the passage. Fuel flow through the line creates a differential pressure on the valve, raising it above the rest position. Circuitry interconnecting the damper drive and position indicating switches and the gas flow switch with the furnace thermostat and the gas line control valve, positions the damper in a closed position when there is no gas flow to the furnace and in an open position otherwise and prevents energization of the gas flow valve when the damper is closed.

13 Claims, 5 Drawing Figures

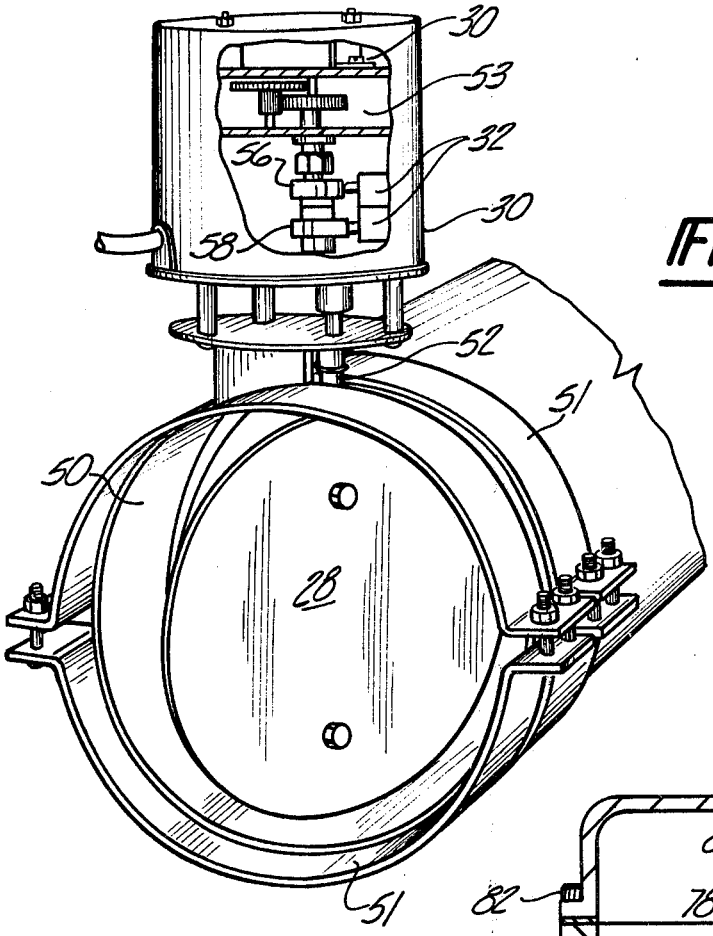
Fig-3
Fig-4
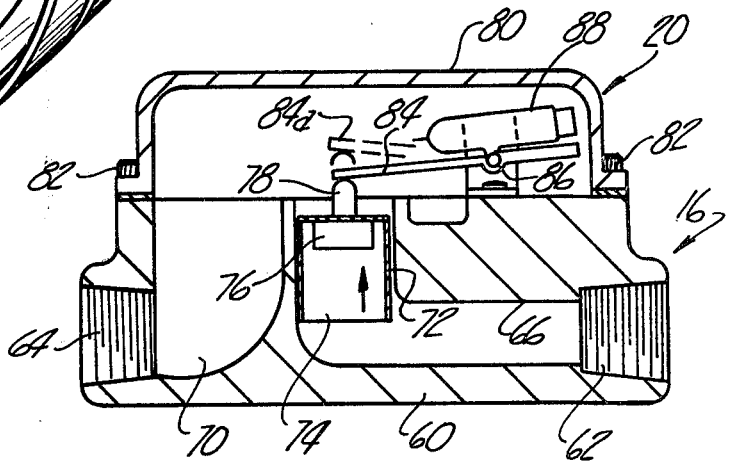
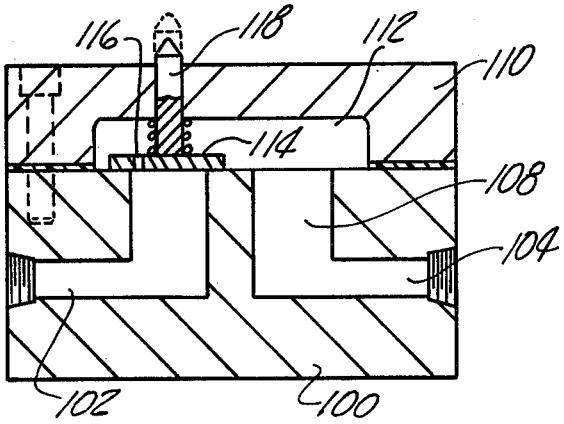
Fig-5

GAS FLOW CONTROLLED FURNACE FLUE DAMPER

BACKGROUND OF THE INVENTION

1. Field of the Invention

This invention relates to a furnace system employing a flue damper which closes when the furnace is off to conserve heat in the combustion chamber and a safety circuit for controlling the damper including a gas flow detector switch of novel construction.

2. Prior Art

Dampers have previously been employed in the exhaust flues of central heating furnaces and the like, which cycle on and off, to close the flues when the furnaces are off. This conserves fuel by retaining heated air in the furnace bonnet to increase the time required for the bonnet temperature to reach atmospheric temperature, and by preventing the flow of hot air from the interior of the building being heated, adjacent the furnace, through the furnace and flue to the atmosphere. Tests have shown that these valves will reduce fuel consumption by as much as about a quarter while improving the comfort of the building being heated by eliminating drafts caused by air flow through the furnace and decreasing the rate of furnace cycling. The savings in fuel cost repay the relatively modest costs of these valves in a very short period of time so that the purchase of the valves as a part of a new furnace system or as an add-on to an existing system is an excellent investment.

Despite these advantages flue damper valves have not achieved any widespread use, primarily because of the hazardous condition which occurs if the valve malfunctions and remains closed while the furnace is fired. The noxious and oxygen deficient exhaust gases then back up in the flue and begin to overflow into the building, creating the danger of asphyxiating the occupants. Most proposed flue damper systems have provided an electric actuator for the damper controlled by the same signal that energizes the electric fuel valve. These systems are susceptible to the actuator failing to move the valve to an opened position when the control signal is received or by the gas shutoff valve sticking in an open position after its control signal is terminated. The possibility of the valve failing to open can be substantially minimized by biasing the valve into an open position with a gravity biased mechanism, requiring the presence of an electrical signal to move the valve to the closed position. The problem of the gas valve sticking in an open position is more difficult to solve and is a more common occurrence. It has been proposed to provide a pair of valves in the gas line so that either one can close off the flow but such systems provide no indication of the malfunction of one of the valves which leaves the system open to dangerous operation upon failure of the other valve. U.S. Pat. No. 2,537,082 proposes a system wherein the flue valve and the gas flow valve are both controlled with a common mechanical actuator. While this system might be utilized with new furnaces specifically designed for its incorporation, it can seldom be installed in an existing furnace without extensive reworking of the gas line and the flue.

SUMMARY OF THE INVENTION

The present invention is broadly directed toward a furnace control system employing a flue damper which is rendered practically failsafe by virtue of use of specialized components connected in a system to control the position of the damper and the energization of the fuel valve. A preferred embodiment of the invention incorporates a fuel flow detector of novel design which cooperates with the associated circuitry to insure that the damper is open when there is a fuel flow to the furnace independently of the state of energization of the fuel feed valve.

The present invention is applicable for use with any furnace employing a fluid fuel, either gaseous or liquid, but is typically applied with a natural gas fueled furnace and the preferred embodiment of the invention will be described in that context. The fuel flow detector is connected in the gas line, either between the supply and the control valve or between the control valve and furnace. The sensor employs a valve member supported for movement in a vertical fuel flow passage. The flow path of fuel through the passage, from the source to the furnace, is in an upward direction. The valve can move vertically between a rest position, at the lower end of the travel, wherein it blocks fuel flow through the valve. When the flow valve is closed the pressures on the bottom and top of the valve equalize and it assumes its rest position under the force of gravity. When the fuel line opens the pressure on the underside of the valve exceeds the pressure on its topside and the valve moves upwardly, unblocking the flow passage.

A mercury switch with normally open and normally closed contacts is supported near its midpoint on a fulcrum so that it naturally falls against a button connected to the upper side of the piston but exerts a very small force on the piston. When the piston lifts it shifts the balance on the mercury switch but only a very slight force is required to maintain the switch in this position.

Typical gas pressures available for use in connection with a residential furnace may be about six to nine inches of water. While this entire force is available to initially open the valve, the valve cannot have an appreciable pressure drop or insufficient pressure will be available to properly operate the burner. The preferred embodiment to the present flow detector valve has a pressure drop of under ½ inch of water and accordingly does not appreciably diminish the pressure available for downstream use. The preferred embodiment of the invention also employs a pair of switches actuated by cams connected to the damper drive motor. One of these switches is closed when the damper is in its open position and the other is closed when the damper is in its closed position. Circuitry interconnecting these damper position switches, the flow sensor switch, the fuel valve and the thermostatic switch control the application of electrical power to the damper drive motor and the gas flow valve. These signals drive the damper into the closed position whenever the sensor indicates that there is no gas flow, open the damper whenever the sensor indicates that there is a gas flow, and allow energization of the gas valve only when the damper is open and the thermostat is on.

This circuit will operate safely despite sticking of the gas valve in the open position or sticking of the damper in its closed position. Since the gas flow detector can only fail by sticking in the open position, in which the flue is maintained open, failure of the gas flow detector will not throw the system into an unsafe condition.

Since the damper must be actuated to move it either to the closed or the opened position, as opposed to previous systems which had one normal position and just powered the damper to the other position, the system is not susceptible to a failure mode in which the furnace continues to run but the damper is locked in an open position, using up substantial quantities of wasted energy.

For the present system to fail in a dangerous condition, three things have to occur simultaneously: (1) the position sensor has to fail in its open position, (2) the damper has to fail in its closed position, and (3) the gas valve has to fail in its open position. The occurrence of these three failures simultaneously is extremely unlikely, rendering the device extremely safe.

It is therefore seen that the present invention provides a simple, low-cost, gas flow detector which insures the safe operation of the flue damper when used in connection with the other system components.

The gas flow detector of the present invention also has utility in connection with devices other than flue damper control. Each example, it may be used in connection with water heaters which employ constantly operating ventilator fans to prevent a hazardous situation arising in the event that the gas line fails. Use of the flow sensor could allow the fan to only operate when there is a gas flow.

Other objectives, advantages and applications of the present invention will be made apparent by the following detailed description of several embodiments of the invention. The description makes reference to the accompanying drawings in which:

FIG. 3 is a perspective view, partially broken away for purposes of illustration, of the damper drive system used with the preferred embodiment of the invention;

FIG. 4 is an elevational sectional view through a preferred embodiment of the gas flow sensor valve; and FIG. 5 is an elevational sectional view through an alternative embodiment of the gas flow sensor valve.

Figure 1:
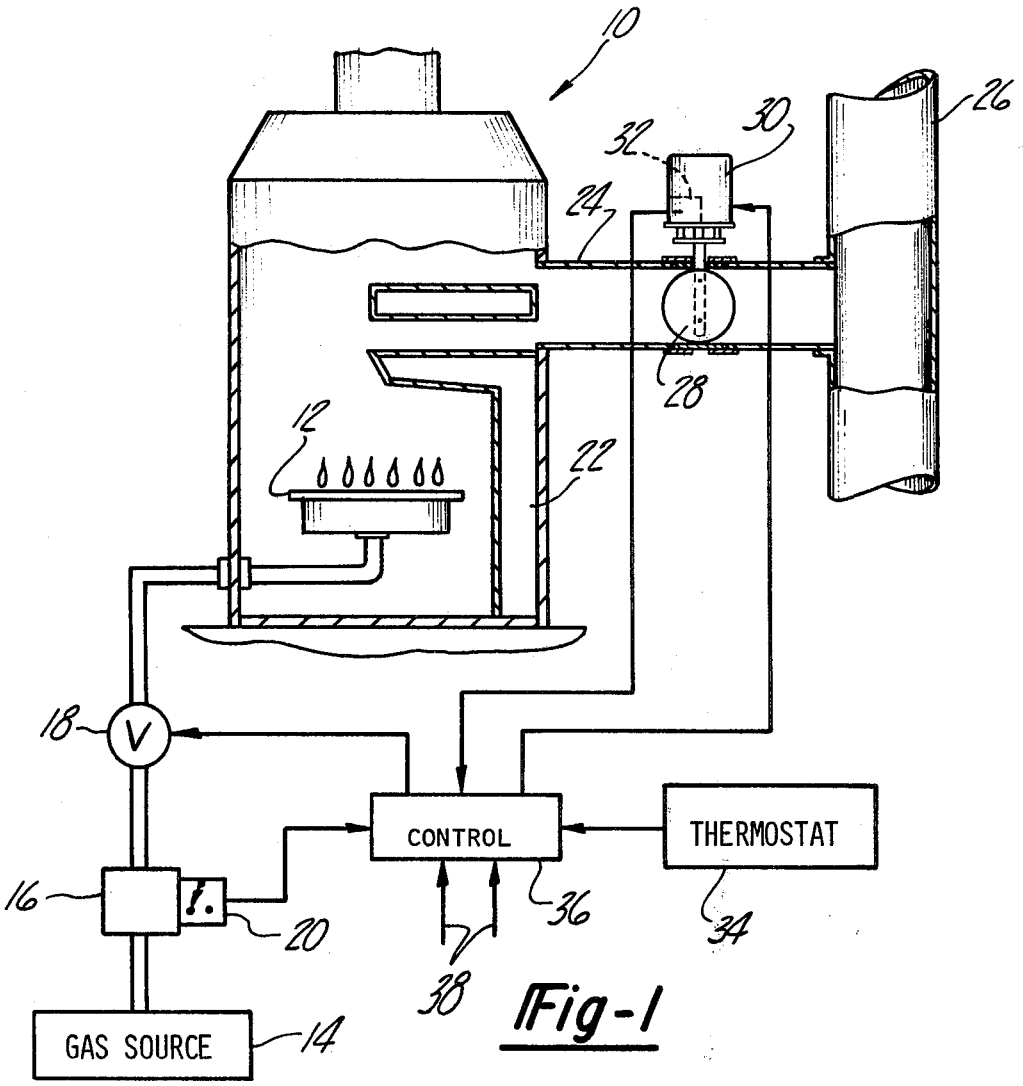
FIG. 1 is a partially schematic elevation view of a furnace system embodying the present invention.

The preferred embodiment of the invention is used in connection with a natural gas fired furnace, generally indicated at 10, although, as has been noted, the furnace system of the present invention is applicable to any fluid fueled furnace, be it oil, propane, etc. The furnace 10 has a burner 12 equipped with a suitable form of ignition apparatus. If a gas powered ignition is employed, rather than an electrical ignition, a pilot light tap must be provided or the flow valve must be designed in the manner of FIG. 6 to allow some small flow to the furnace even when the flow sensor is in its closed position.

The gas for the burner 12 is provided from a source 14 through a flow sensor 16 to an electrically actuated gas flow valve 18, which in turn connects to the burner 12. The flow sensor 16, which is illustrated in detail in FIGS. 4 and 5, is diagrammatically indicated as containing a single pole double throw switch 20 having a first position when the gas flow is effectively cut off and a second position when the gas is flowing. As a practical matter, the flow sensor 16 monitors the condition of the gas flow valve 18 and the sensor switch 20 has one position when the gas flow valve is closed. This signal is generated independently of the state of energization of the gas valve 18 so that if the valve is energized to be in a closed position but is actually opened, the flow detector will provide a signal indicating that open state.

The exhaust gases from the furnace 10 pass through an appropriate heat exchanger 22 and out through a flue connection 24 to a chimney 26. The upper end of the chimney is normally connected to the atmosphere.

The flue 24 is equipped with a damper valve 28 which may be disposed in an open position wherein it freely allows passage of exhaust gases through the flue into the chimney, or a closed position wherein it partially or completely blocks the flue. The damper 28 is positioned by a drive motor 30 and a pair of switches 32 associated with the drive motor signal the position of the damper.

The furnace system may be manually controlled to go on or off but is preferably controlled by some form of thermostat device 34 positioned in the area to be heated. In more sophisticated systems, the on-off signal for the system may be derived from a computer or the like.

The thermostat 34, as well as the flow sensor switch 20 and the damper position switches 32 are connected to a central control 36. Based on these input signals, the control energizes the gas flow valve 18 and the damper drive 30. A source of electric power 38 is connected to the control 36 to provide power for energizing the elements.

Figure 2:
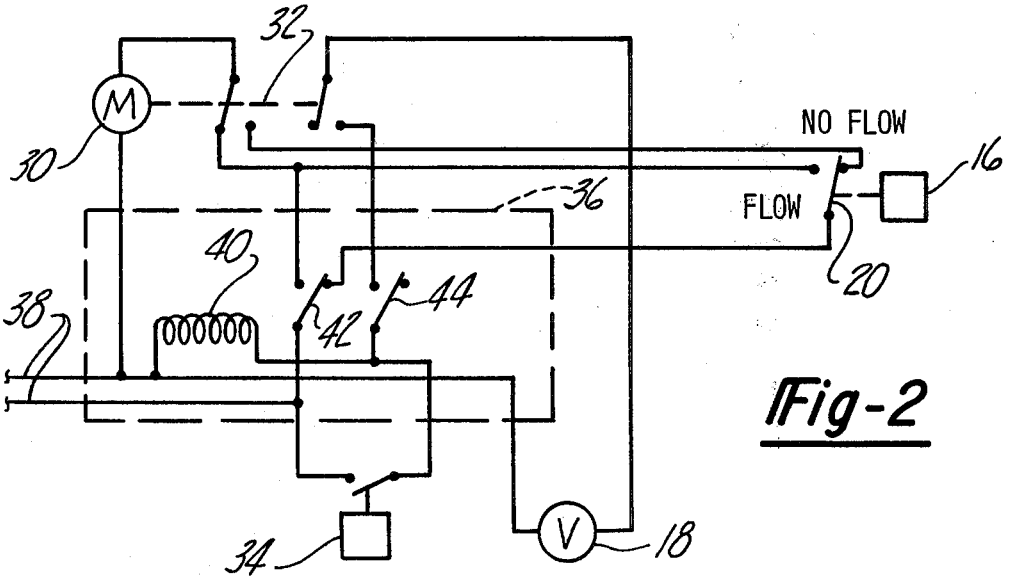
FIG. 2 is an electrical schematic diagram of the apparatus of the present invention.

The preferred arrangement of the electrical interconnection of the elements is schematicaly illustrated in FIG. 2. The control box 36 contains a relay having a coil 40 and a pair of single pole double throw contacts 42 and 44. The coil 40 is connected in series with the switches of the thermostat 34 across the power line 38 so that when the thermostat is closed, signaling the powering of the furnace, the coil 40 is energized.

The flow control valve 18 has one terminal connected to one side of the power line and the other terminal connected to the power line through one of the damper position switches 32 and the thermostat control switch 44. The two damper position switches are shown in the position in which the damper is closed. In this position the gas flow valve 18 can receive no power. When the damper is driven to the open position and the thermostat is closed, energizing the coil 40, power is applied to the other side of the flow control valve 18 through the relay contacts 44 (which are illustrated in a non-energized position).

The flow sensor switch 20 is illustrated in its no-flow position. Its common terminal is connected to one side of the power line through one set of contacts of the relay 42 when the relay coil 40 is energized. The other two contacts of the switch 20 are connected to the damper drive motor 30 through one of the switches 32. The arrangement is such that when the relay 40 is de-energized the drive motor is energized if it is in its open position, to drive it to its closed position, as long as there is no gas flow. If there is a gas flow, and the damper is in its closed position, the motor 30 is energized to drive it to its open position. The motor is also energized to drive the damper to its open position if it is closed and the thermostat switch closes, through contacts of the switch 42.

The summary of the operation of the system to control the damper motor 30 and the gas flow valve 18 for various conditions of the thermostat, flow valve, and damper is as follows:

| | THERMOSTAT | FLOW | DAMPER | ACTION |
|---|---|---|---|---|
| 1 | Off | No | Closed | No |
| 2 | Off | No | Open | Close Damper |
| 3 | Off | Yes | Closed | Open Damper |
| 4 | Off | Yes | Open | No |
| 5 | On | No | Closed | Open Damper |
| 6 | On | No | Open | Energize Fuel Valve |

-continued

| | THERMOSTAT | FLOW | DAMPER | ACTION |
|---|---|---|---|---|
| 7 | On | Yes | Closed | Open Damper |
| 8 | On | Yes | Open | Energize Fuel Valve |

The preferred nature of the physical structure of the damper valve 28, its drive motor 30 and the position sensor switches 32 are illustrated in FIG. 3. The damper 28 consists of a circular sheet metal plate supported for rotation within a short section of cylindrical sheet metal duct 50. The duct may form part of a longer flue section or may be attached within an short section of cylindrical sheet metal duct 50. The duct may form part of a longer flue section or may be attached within an existing flue section by conventional circular pipe clamps 51. The drive motor 30 is supported externally of the flue duct section 50 and drives a shaft 52 connected to the pivot axis of the damper 28 through speed reduction gearing 53. The shaft 28 carries a pair of cams 56 and 58 which actuate a pair of switches 32 to provide signals that indicate that the damper 32 is disposed in either its open or its closed position. The motor drive is unidirectional. In the event that the motor becomes locked in its energized position the damper will continually rotate to provide an effectively open damper position.

FIG. 4 illustrates a preferred arrangement of the flow sensor 16 and its associated switch 20. The sensor is built about a body 60, preferably formed of metal such as aluminum, having a fitting 62 at one end adapted to be connected to a gas source line and a fitting 64 at the other end adapted to be connected to a gas receiving line communicating with the furnace or other utilization device. A passage 66 leads from the input end 62 to a vertically aligned cylindrical passage 68 opening to the top of the body and terminating at a flat top. The output end 64 is connected to the top of the body by a passage 70.

A valve member 72 has cylindrical outer sides which make a loose sliding fit with the walls of the vertical passage 68. The valve 72 is preferably molded of plastic, for light weight, and has a cylindrical shape with an opened bottom 74 and thin side and top walls. Four symmetrically arranged side ports 76 are formed in the sidewalls of the valve, just below the top surface. The valve has an upwardly projecting button 78 extending from its top surface.

In FIG. 4 the valve 72 is shown at the low point of its vertical travel. In this position its bottom edge abuts the curved connection between the horizontal passage 66 and the vertical passage 68 and the ports 76 are in abutment with the sidewalls of the passage 68 so the valve blocks fluid flow through the passage 68. The valve assumes this position under gravity forces when the pressures on its upper and lower sides are equalized. When the gas flow valve 18 is closed the valve 72 should assume this rest position.

When the valve 18 is opened a higher pressure will be exerted on the bottom of the valve 72 than exists on its upper surface. This is true whether the flow valve 18 is upstream or downstream of the flow sensor 16. When this occurs, the unbalanced forces raise the piston 72 within the chamber 68 until the tops of the ports 76 extend above the sidewalls of the chamber 68, allowing gas flow through the interior of the piston and out of the ports.

A cover 80, retained on the body by screws 82, directs the gas flow through the passage 70 to the outlet 64. During continuation of the gas flow the piston 72 is maintained in this elevated condition. Because of its light weight it reduces the downstream gas pressure by only a very slight amount.

The piston button 78 is in contact with a flapper board 84 that is pivotably supported on a fulcrum 85 affixed to the top of the sensor body 60. An elongated glass tube mercury switch 88 is supported on the flapper board. The tube 88 contains the sensor switches 20 with normally open contacts at each end of the tube. When the tube is inclined about the fulcrum 86 so that one end is lower than the other the contact set at the lower end is bridged by mercury in the tube to electrically close those contacts. The contact set at the upwardly inclined end of the tube is opened.

The balance of the flapper board and the tube is such as to incline the flapper downwardly to the left, as viewed in FIG. 4, so that the board contacts the button 78. When the piston 72 rises under gas pressure the flapper board is tilted upwardly, into the phantom position illustrated at **84*a* and the tube pivots to open one contact set of the switch 20** and close the other contact set.

An alternative form of construction of the flow sensor is illustrated in FIG. 5. A valve body 100 has an input passage 102 connected to a gas source and an outlet passage 104 connected to the utilization device. Both passages open to the top of the body through vertical passages 106 and 108 respectively. The top of the body is closed by a cover 110 that contains a volume 112 that communicates the passages 106 and 108 to one another.

A valve member 114 has a flat head that rests on the top of the passage 106 in the absence of a pressure differential between the inlet and the outlet. The head of valve 114 has a small hole 116 formed through its surface which allows a continuous gas flow through the valve for a pilot light. The valve 114 has an upwardly extending rod 118 affixed to its top surface and the rod is guided in a bore in the cover 110 so that the upper end of the rod extends beyond the cover to actuate a suitable switch.

A pressure differential between the inlet and outlet of the valve causes upward net forces on the head 114 which raises the head unblocking the top of the passage 106 to allow gas flow through the valve. Motion of the rod 118 is communicated to the switch which provides a signal of this condition.

The embodiments of the invention in which an exclusive property or privilege is claimed are defined as follows:

1. A control system for a combustion heating device having a fluid fuel input line and an exhaust flue, comprising: a damper supported in the flue for motion between open and closed positions; a drive system for the damper operative to move the damper between open and closed positions; an electric switch having an output dependent upon the position of the damper; an electrically energized valve disposed in said fuel line; a flow detector supported in said fuel line operative to provide an electrical output signal having a first state when fuel is flowing through the line and a second state when no appreciable fuel is flowing through the line and electric control circuit means interconnecting the drive system, the switch, the flow detector and the valve preventing energization of the valve to allow fuel flow through the line until the output of the switch is such as to indicate that the damper is open and causing said damper drive system to maintain said damper in said open position and to cause the drive system to move the damper to its open position when it is not in its open position whenever said flow detector electrical output signal is in its first state and fuel flow is occurring through said line, whereby the damper is prevented from blocking the exhaust flue while fuel is being provided to the furnace.

2. The control system of claim 1 wherein the damper is rotatable about an axis extending normally to the central axis of the flue and the drive system consists of a rotary electric motor operative to rotate the damper about its support axis.

3. The control system of claim 1 wherein the electric switch comprises a pair of on-off switch devices, one having a first state when the damper is in its closed position, and a second state at all other times, and the other having a first state when the damper is in its open position and a closed state at all other times.

4. The control system of claim 2 wherein the damper drive motor is unidirectional.

5. A control system for a furnace having a fluid fuel input line and exhaust flue, comprising: a damper supported in the flue; a drive system for the damper operative to move the damper between an open and a closed position; a flow detector supported in said fuel line and operative to provide an electrical output signal having a first state when the fuel flow through the line, to the furnace, exceeds a predetermined level and a second state when a fuel flow is below said level; a thermostat controlled switch for the furnace; a fuel valve disposed in the fuel line; and electrical circuitry interconnecting the damper drive, the flow detector, the thermostat controlled switch, and the fuel valve, operative to prevent opening of the fuel valve when the flue damper is in its closed position and to prevent the closing of the damper when the output signal of the detector is in its first state.

6. The control system of claim 5 wherein the flow detector includes a vertical flow passage connected to the fuel line to provide an upward flow through the passage and a valve member supported for movement in the passage between a lower, rest position wherein it blocks substantial fluid flow through the passage, and a raised condition wherein it allows fluid flow through the passage, to which raised position the valve is moved when the pressure on its underside appreciably exceeds the pressure on its upper side.

7. The control system of claim 6 wherein the flow detector further includes an electrical switch having an output state dependent upon the position of the piston.

8. The control system of claim 7 wherein the electrical switch comprises an elongated mercury switch supported for pivoting motion about an axis normal to its longitudinal axis.

9. The control system of claim 8 including a mechanical connection between one end of said mercury switch and said piston.

10. The control system of claim 9 wherein the mercury switch is supported so that gravity biases its end mechanically connected to the piston so that it bears against the piston.

11. A control system for a furnace having a fuel feed line and an exhaust flue, comprising: a damper supported within the flue for movement between closed and opened positions; a drive system for the damper; a damper indicator operative to provide a first electrical signal when a damper is in a closed position and a second electrical signal when the damper is in an open position; a thermostatic switch; an electrically actuated fuel valve positioned in the fuel feed line; a flow detector positioned in the fuel feed line and including a valve movably supportable with respect to a vertically aligned fuel feed passage so that the valve is moved into a raised position when the pressure on the underside of the valve exceeds the pressure on its upper side, and is in a lowered position when the pressure is equal on both its sides, and including a switch operative to provide a first electrical signal when the valve is in a raised position and a second electrical signal when the valve is in a lowered position; and electrical circuitry interconnecting the damper drive, the thermostatic switch, the fuel valve and the flow detector switch to allow closure of the fuel valve only when the thermostatic switch is closed and the damper is in an open position and to retain the damper in an open position when the switch associated with the flow detector provides said first electrical signal.

12. A control system of claim 11 wherein said vertically aligned fuel feed passage is substantially cylindrical and said valve has cylindrical side walls complementary to the passage and is positioned within the passage, and said valve includes at least one side port which is closed when the valve is fully within the passage and opens when a portion of the valve extends above the top edge of the passage.

13. The control system of claim 11 wherein said vertically aligned fuel feed passage has a substantially horizontal upper edge and said valve rests on said upper edge to block fuel flow through the passage when the pressures on its underside and upper side are substantially equal, and is raised above the top edge of the passage when the pressure on its underside substantially exceeds the pressure on its upper side, to allow fuel flow through the passage.

* * * * *